US012433433B2

(12) United States Patent
Jaye

(10) Patent No.: US 12,433,433 B2
(45) Date of Patent: Oct. 7, 2025

(54) WEIGHTED BODY PILLOW

(71) Applicant: Riley Jaye, San Diego, CA (US)

(72) Inventor: Riley Jaye, San Diego, CA (US)

( * ) Notice: Subject to any disclaimer, the term of this patent is extended or adjusted under 35 U.S.C. 154(b) by 168 days.

(21) Appl. No.: 18/369,062

(22) Filed: Sep. 15, 2023

(65) Prior Publication Data

US 2024/0138601 A1 May 2, 2024

Related U.S. Application Data

(60) Provisional application No. 63/419,579, filed on Oct. 26, 2022.

(51) Int. Cl.
*A47G 9/10* (2006.01)

(52) U.S. Cl.
CPC ..... *A47G 9/10* (2013.01)

(58) Field of Classification Search
CPC ... A47G 9/10; A47G 2009/1018; A47G 9/109
See application file for complete search history.

(56) References Cited

U.S. PATENT DOCUMENTS

| | | | | | |
|---|---|---|---|---|---|
| 4,901,384 | A * | 2/1990 | Eary | A47C 20/021 | D6/601 |
| 5,097,551 | A * | 3/1992 | Smith | A47G 9/10 | 5/652 |
| 7,472,443 | B2 * | 1/2009 | Littlehorn | A47C 20/025 | 5/652 |
| 9,307,842 | B2 * | 4/2016 | Gibbons | A47C 20/021 | |
| 10,736,444 | B1 * | 8/2020 | Leach | A47G 9/0253 | |
| 11,564,503 | B2 * | 1/2023 | Gregory | A47C 20/023 | |
| 2008/0235877 | A1 * | 10/2008 | Murray | A47G 9/10 | 5/636 |
| 2009/0149698 | A1 | 6/2009 | Tastard | | |
| 2012/0102654 | A1 * | 5/2012 | Lee | A47G 9/0253 | 5/645 |
| 2015/0091357 | A1 * | 4/2015 | Register | A47C 7/383 | 297/411.23 |
| 2016/0135624 | A1 * | 5/2016 | Heidtmann | C08G 18/797 | 5/636 |
| 2018/0213954 | A1 * | 8/2018 | Grinstead | A47G 9/1036 | |
| 2019/0021525 | A1 | 1/2019 | Hamm | | |
| 2021/0068561 | A1 * | 3/2021 | Adeeb, Jr. | A47C 7/425 | |
| 2021/0235899 | A1 * | 8/2021 | Silva | A47G 9/0253 | |
| 2021/0337989 | A1 * | 11/2021 | Hunsinger | A47G 9/10 | |

FOREIGN PATENT DOCUMENTS

| | | | | |
|---|---|---|---|---|
| GB | 2598153 B | | 9/2022 | |
| JP | 2008188157 A | * | 8/2008 | |
| JP | 2019051003 A | | 4/2019 | |
| JP | 2021061956 A | | 4/2021 | |
| WO | WO-9937185 A1 | * | 7/1999 | A47G 9/10 |

* cited by examiner

*Primary Examiner* — David E Sosnowski
(74) *Attorney, Agent, or Firm* — Procopio, Cory, Hargreaves & Savitch LLP

(57) ABSTRACT

A weighted body pillow comprises a pillow casing; a weighted core within the pillow casing, wherein the weighted body pillow is configured to be cradled between a user's arms and legs while sleeping on the user's side, ensuring proper spinal alignment.

9 Claims, 2 Drawing Sheets

WEIGHTED BODY PILLOW

FIELD OF THE INVENTION

The present invention relates to body pillows that aid in sleep.

SUMMARY OF THE INVENTION

An aspect of the disclosure involves a weighted body pillow provided with a weighted core. This weighted core can contain a variety of materials such as sand, glass beads, plastic pellets, rubber pellets, etc.

The filling is sewn into a quilt-like pattern to form the core, which is then sewn into the center of the body pillow. After stuffing both halves of the pillow with fill (down, polyester, feathers, memory foam, etc.) the pillow is sealed off at a final weight of roughly 6-16 lbs.

Another aspect of the disclosure involves a weighted body pillow comprising a pillow casing; a weighted core within the pillow casing, wherein the weighted body pillow is configured to be cradled between a user's arms and legs while sleeping on the user's side, ensuring proper spinal alignment.

One or more implementations of the above aspect of the disclosure involves one or more of the following: the weighted core includes a filler from at least one of glass beads, sand, rubber pellets, and plastic pellets; the weighted core includes a plurality of pockets including a filler, the plurality of pockets having an oval configuration; the pillow casing includes a center and the weighted core includes a plurality of pockets and a periphery sewn to the pillow casing so that the plurality of pockets extend continuously in the center of the pillow casing, forming two halves on opposite exterior sides of the weighted core; the two halves are stuffed with a filling; the filling is at least one of down, polyester, feathers, and memory foam; the weighted core and the filling are encapsulated by the pillow casing; the weighted body pillow weighs 6-16 lbs.; and/or the weighted body pillow has a length of 3-6 ft. and a width of 1-3 ft.

A further aspect of the disclosure involves a method of using a weighted body pillow comprising a pillow casing and a weighted core within the pillow casing. The method includes ensuring proper spinal alignment by the weighted body pillow being cradled between a user's arms and legs while the user is laying on the user's side.

One or more implementations of the immediately above aspect of the disclosure involves one or more of the following: the weighted core includes a filler from at least one of glass beads, sand, rubber pellets, and plastic pellets; the weighted core includes a plurality of pockets including a filler, the plurality of pockets having an oval configuration; the pillow casing includes a center and the weighted core includes a plurality of pockets and a periphery sewn to the pillow casing so that the plurality of pockets extend continuously in the center of the pillow casing, forming two halves on opposite exterior sides of the weighted core; the two halves are stuffed with a filling; the filling is at least one of down, polyester, feathers, and memory foam; the weighted core and the filling are encapsulated by the pillow casing; the weighted body pillow weighs 6-16 lbs.; and/or the weighted body pillow has a length of 3-6 ft. and a width of 1-3 ft.

DETAILED DESCRIPTION OF PREFERRED EMBODIMENTS

Figure 1:
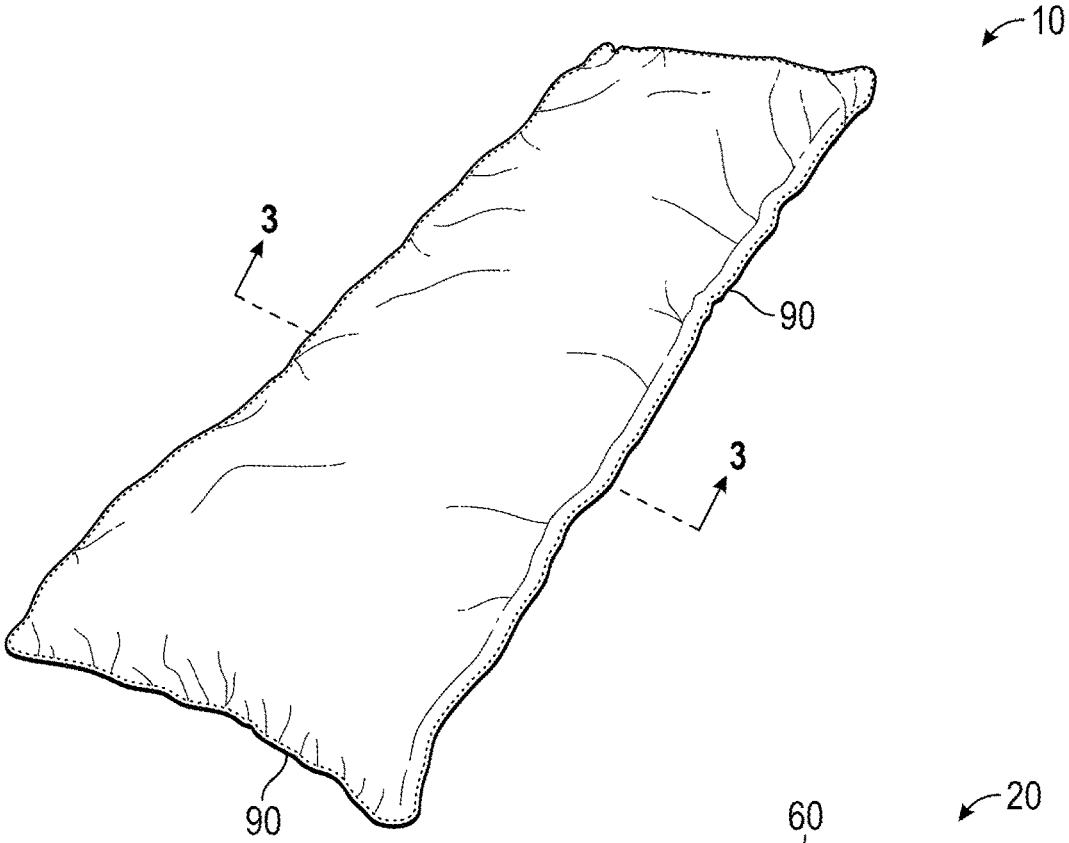
FIG. 1 is a perspective view of an embodiment of a weighted body pillow.
Figure 2:
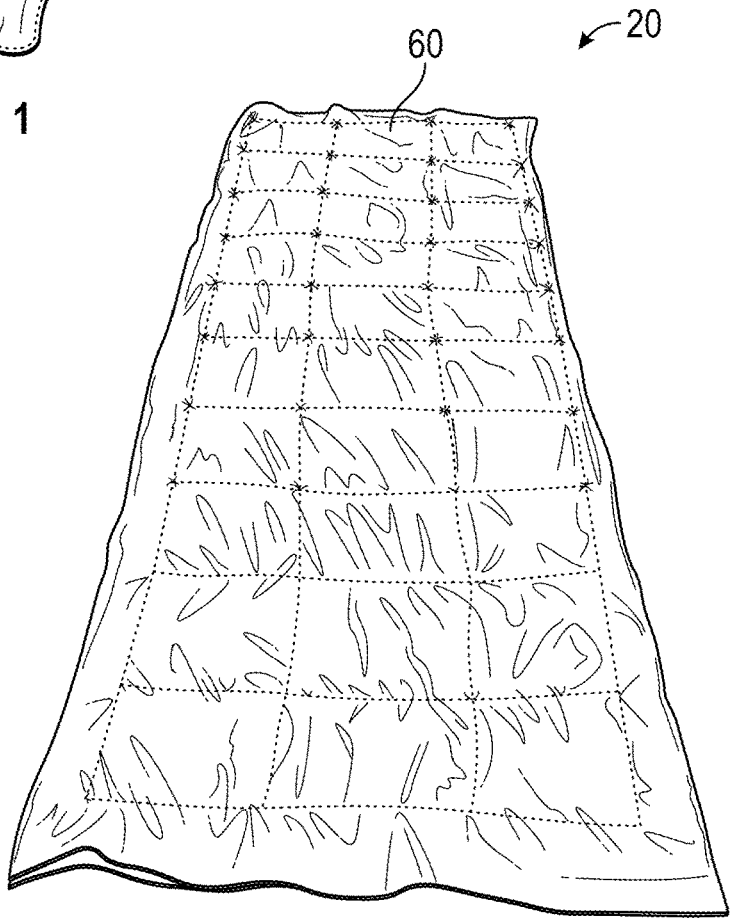
FIG. 2 is a perspective view of an embodiment of a weighted core with individual pockets with weighted material therein of the weighted body pillow.
Figure 3:
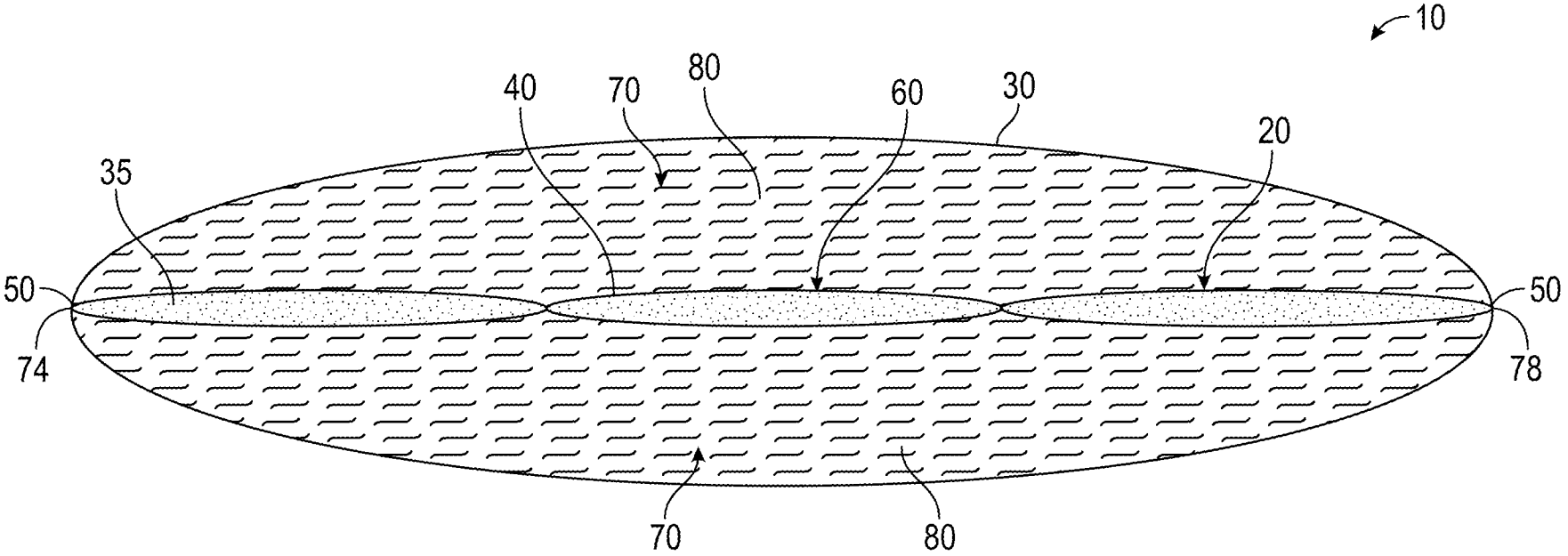
FIG. 3 is a cross-sectional view taken along lines 3-3 of FIG. 1 of the weighted body pillow, and illustrates final layer with filler and weighted core inside.

With reference initially to FIGS. 1-3, an embodiment of a weighted body pillow 10 will be described. The weighted body pillow 10 is meant to be cradled between a user's arms and legs while sleeping on their side, and includes a weighted core 20 within a pillow casing/final layer 30.

The weighted core 20 may contain a filling/filler 35 of a variety of materials such as, but not limited to, glass beads, sand, rubber pellets, plastic pellets, etc. The filling 35 is sewn into a quilt-like pattern/pockets 40 to form the weighted core 20. A periphery 50 of the weighted core 20 is then sewn into a center 60 of the pillow casing 30, forming two hollow halves 70 on opposite exterior sides of the weighted core 20. In the embodiment shown in FIG. 3, in a cross-sectional view along a lateral section of the weighted body pillow 10, both the pockets 40 and the pillow casing have an oval configuration and the pockets extend continuously through the center 60 from one side 74 to an opposite side 78.

Both halves 70 are stuffed with the filling 80 so that the weighted core 20 is sandwiched on both sides by the filling 80, which may include, without limitation, down, polyester, feathers, memory foam, etc.

The weighted core 20 and the filling 80 are encapsulated by the pillow casing/final layer 30, which is sealed off at edge(s) 90.

A final weight of the weighted body pillow 10 is approximately 6-16 lbs. and the dimensions of the weighted body pillow 10 are 3-6 ft. in length and 1-3 ft. in width.

The presence of the weighted core 20 in the center 60 of the weighted body pillow 10 allows the pillow to be used as a sleep aid. The weighted core 20 of the weighted body pillow 10 substantializes the object a user is interacting with while sleeping (versus a normal body pillow). The additional weight provides pressure to the user's body which encourages natural relaxation and, in-turn, a better night's sleep. The weighted body pillow 10 is cradled between the user's arms and legs while they lay on their side, which ensures proper spinal alignment. The overall improvement in sleep quality the weighted body pillow 10 promotes is intended to reduce feelings of stress, anxiety, and depression while combating symptoms of fatigue.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A method of using a weighted body pillow, comprising:

providing the weighted body pillow comprising a pillow casing; a weighted core within the pillow casing, the weighted core including a plurality of pockets arranged in a grid and extending predominantly laterally from an end of one side to an opposite end of an opposite side of the pillow casing, the pockets being arranged in direct contact with adjacent lateral pockets;

ensuring spinal alignment by the weighted body pillow being cradled between a user's arms and legs while the user is laying on the user's side.

2. The method of claim 1, wherein the weighted core includes a filler from at least one of glass beads, sand, rubber pellets, and plastic pellets.

3. The method of claim 1, wherein each of the plurality of pockets having a filler.

4. The method of claim 2, wherein the pillow casing includes a center and the weighted core includes a plurality of pockets and a periphery sewn to the pillow casing so that the plurality of pockets extend continuously in the center of the pillow casing, forming two halves on opposite exterior sides of the weighted core.

5. The method of claim 4, wherein the two halves are stuffed with a filling.

6. The method of claim 5, wherein the filling is at least one of down, polyester, feathers, and memory foam.

7. The method of claim 5, wherein the weighted core and the filling are encapsulated by the pillow casing.

8. The method of claim 1, wherein the weighted body pillow weighs 6-16 lbs.

9. The method of claim 1, wherein the weighted body pillow has a length of 3-6 ft. and a width of 1-3 ft.

* * * * *